United States Patent [19]

Spletzer

[11] 4,354,181

[45] Oct. 12, 1982

[54] VAPOR LAMP INDICATING DEVICE

[75] Inventor: Barry L. Spletzer, Fremont, Mich.

[73] Assignee: Gerber Products Company, Fremont, Mich.

[21] Appl. No.: 202,916

[22] Filed: Nov. 3, 1980

[51] Int. Cl.[3] ..... G08B 21/00

[52] U.S. Cl. ..... 340/642; 340/641

[58] Field of Search ..... 340/641, 642, 643, 662; 324/414; 315/130, 131

[56] References Cited

U.S. PATENT DOCUMENTS 3,593,274 7/1971 Krugler, Sr. ..... 340/642

4,260,985 4/1981 Hayden ..... 340/641

*Primary Examiner*—Gerald L. Brigance

*Attorney, Agent, or Firm*—Townsend and Townsend

[57] ABSTRACT

A device for indicating when one or more fluorescent lamps in a bank of fluorescent lamps burns out requiring only a single indicator is disclosed. The device includes a voltage divider connected to a terminal of each lamp to produce a signal proportional to the voltage supplied by a ballast to the terminal of the lamp. These signals are then summed at a common summing terminal. The voltage at the summing terminal is approximately equal to the largest voltage of the individual signals produced at each lamp. The signal at the summing terminal is modified, typically through an adjustable voltage divider, to produce a third signalwhich is applied to the gate of an SCR. The adjustable voltage divider is designed so that when any one of the lamps goes out producing a substantial rise in the voltage applied by the ballast to the lamp, the SCR will be triggered. An indicator bulb is connected to the anode of the SCR so that when the SCR triggers, the bulb lights indicating one or more of the lamps are burned out.

11 Claims, 1 Drawing Figure

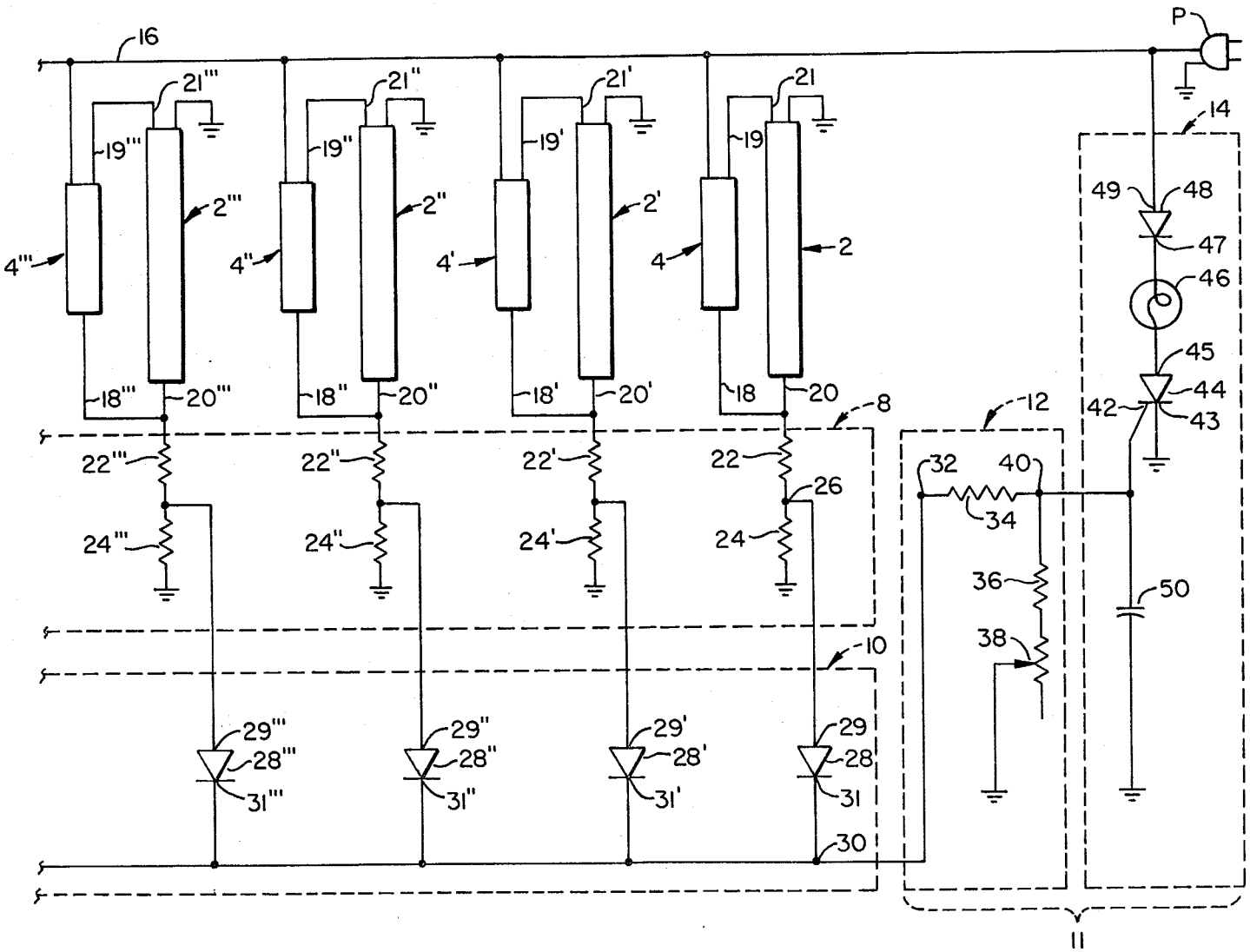
P
14
48
47
46
45
44
43
49
42
50
11
12
40
34
36
38
32
8
10
2
20
26
29
28
31
30
21
19
18
22
24
4
2'
20'
29'
28'
31'
21'
19'
18'
22'
24'
4'
2''
20''
29''
28''
31''
21''
19''
18''
22''
24''
4''
2'''
20'''
29'''
28'''
31'''
21'''
19'''
18'''
22'''
24'''
4'''
16

VAPOR LAMP INDICATING DEVICE

BACKGROUND OF THE INVENTION

Vapor lamps, including fluorescent, mercury vapor, and neon lamps, all possess negative resistance characteristics. That is, the resistance of the lamp decreases with an increase in current. Therefore, without some sort of current-limiting device, after the lamp is initially started the current would rise swiftly until the lamp failed. These current-limiting devices, generally called ballasts, can be resistive, capacitive or inductive. Resistance ballasting is inefficient so that inductive and capacitive ballasts are much more common.

One type of fluorescent lamp uses what is called an instant-start circuit. This arrangement requires a relatively high voltage to the lamp so that the ballast is often a transformer with capacitors. When the lamp is operating normally, the ballast will exhibit a mid-range voltage, such as 350–400 volts. However, if the lamp is burned out, the ballast will exhibit a high voltage such as 750–900 volts. Most fluorescent light fixtures have a switch which disconnects the ballast from the terminals of these fixtures when the lamp is removed for safety during maintenance operation. Therefore, when the lamp is removed the voltage applied to the terminals of the fluorescent lamp fixture is zero.

One type of fluorescent lamp produces ultraviolet light and is commonly used in sterilization chambers. Since large doses of ultraviolet light is harmful to the human eye, the sterilizing chambers are typically enclosed. Such chambers often have a bank of ultraviolet lights, for example 12–20, within the sterilization chamber. One problem which arises is that if one or more of the lights burns out, the operator has no ready indication that such has happened. The result can be incomplete sterilization and subsequent growth of pathogens.

If desired, the operator of the sterilization line could monitor the light output from each individual lamp within a chamber via a separate monitor coupled to each individual lamp. However, such multiplistic monitoring can be expensive and may require more of the operator's attention than is desired. Therefore, what is missing in the prior art is an inexpensive device that would indicate to the operator when one or more of the ultraviolet fluorescent lamps are burned out.

SUMMARY OF THE INVENTION

A device for indicating when one or more fluorescent lamps in a bank of fluorescent lamps burns out, by monitoring the output voltage of the ballasts, is disclosed. Fluorescent lamps, as well as other vapor lamps, use current limiting devices called ballasts because of the negative resistance characteristics of vapor lamps. When a lamp burns out the voltage applied by the ballast to the electrodes of the lamp increases substantially.

In the present invention a separate voltage divider is connected to a terminal of each lamp to produce a number of first signals proportional to the voltage supplied by the individual ballast to that lamp. These first signals are then summed at a common summing terminal to produce a second signal. The first signals each pass through a diode prior to being combined at the summing terminal so that the voltage at the summing terminal (the second signal) is generally equal to the largest voltage of the first signals produced at each lamp. The second signal at the summing terminal is modified, typically through an adjustable voltage divider, to produce a third signal which is applied to the gate of a silicon controlled rectifier, or SCR.

The adjustable voltage divider of the signal modification portion of the circit is designed so that when any one of the lamps goes out, producing a corresponding rise in the voltage applied by the ballast to that lamp, the SCR will be triggered. An indicator bulb is connected in series with the SCR so that when the SCR triggers, the bulb lights indicating to the operator that one or more of the lamps are burned out.

The present invention provides an indicator which is simple in design and uses inexpensive components. It recognizes and uses the inherent voltage output characteristics of the ballasts. Therefore, no separate detectors are required. The user need merely provide a voltage divider and a diode for each individual lamp. The output from these are summed and only when the voltage is above a predetermined level is a trigger circuit activated. The trigger circuit in the preferred embodiment includes a signal modifying circuit, which is typically an adjustable voltage divider, and an indicating circuit comprising an SCR, an indicator lamp, a diode, and a capacitor. Further, the operator need only be concerned with a single indicator lamp rather than a bank of individual indicating lamps or gages.

The present indicating device is not sensitive to the number of lamps used. This is so because the voltage at the summing terminal is approximately equal to the largest voltage produced across the individual voltage dividers of each lamp. Also, when a lamp is removed from its fixture, since the ballast is disconnected from the terminals of commercial fluorescent fixtures as a safety measure, the operation of the circuit is not affected. Therefore, the only condition that triggers the indicating bulb is a burned out lamp, not a removed lamp.

Other features and advantages of the present invention will appear from the following description in which the preferred embodiment has been set forth in detail in conjunction with the accompanying drawing.

BRIEF DESCRIPTION OF THE DRAWING

The FIGURE is a circuit diagram disclosing the preferred embodiment of the present invention.

DETAILED DESCRIPTION OF THE PREFERRED EMBODIMENT

Turning now to the FIGURE, the present invention includes generally a bank of fluorescent lights 2, each fluorescent light 2 connected to its associated ballast 4, a first signal producing voltage divider network 8, a summing network 10 and a trigger circuit 11. The trigger circuit includes an adjustable signal modifying circuit portion 12 and an indicating circuit portion 14.

Ballast 4 is powered by line 16 connected to plug P which connects to an alternating current source (not shown). The ballast has two outputs 18, 19 connected respectively to terminals 20, 21 on fluorescent lamp 2. Terminals 20, 21 are connected to electrodes at each end of the lamp.

When the lamp is operating properly, the voltage at terminals 20 and 21 is at a mid-range voltage of approximately 350–400 volts. However, when the lamp burns out, the voltage supplied to terminals 20, 21 through outputs 18, 19 of the ballast increases to approximately 750–900 volts. It is this increase that is sensed by the following circuit.

Voltage divider network 8 includes a first resistor 22 and a second resistor 24 connected in series at a common terminal 26. First resistor 22 is connected at its input to terminal 20 of lamp 2 while the output of second resistor 24 is connected to ground.

The preferred embodiment has thus far been described with reference to the elements using unprimed numerals. However, it should be understood that the present invention is operative with one or more lamps 2, ballasts 4, and their associated outputs 18, 19, terminals 20, 21, 26 and resistors 22, 24. These additional elements are indicated in the figure by primed numerals.

The signals produced at terminals 26 are all fed into summing network 10. The summing network comprises a number of diodes 28, each connected at its anode 29 to its respective terminal 26. The cathodes 31 of the diodes are all connected together at a summing terminal 30. The voltage at this summing terminal will be approximately equal to the largest voltage exhibited at terminal 26. Therefore, during operation of the bank of lamps this voltage will remain relatively constant unless one of the lamps 2 burns out.

An input 32 to adjustable signal modification circuit portion 12 is connected to summing terminal 30. Circuit portion 12 includes a voltage divider comprising a third resistor 34, a fourth resistor 36, and a variable resistor 38. Thus, the signal from summing terminal 30 is divided between resistor 34 on one hand and resistors 36 and 38 on the other at an output terminal 40, the output of variable resistor 38 connected to ground.

Output terminal 40 between resistors 34 and 36 is connected to gate 42 of a silicon controlled rectifier (SCR) 44 in the indication circuit portion 14 of the trigger circuit 11. The cathode 43 of SCR 44 is connected to ground while the SCR's anode 45 is connected in series to an indicator bulb 46 and the cathode 47 of a diode 48. The anode 49 of diode 48 is connected to power line 16. Also connected between output terminal 40 and ground is a capacitor 50 which is needed for proper triggering action of the SCR.

The operation of the device is generally as follows. Ballasts 4 each produce a first voltage at terminals 20, 21. Resistors 22, 24 divide their respective first voltage between them. The voltages across resistors 24 are fed into summing network 10 at the anodes 29 of diode 28. Diodes 28 serve to block reverse current flow when a high voltage condition exists, that is, when one of the lamps are out, so that the signal at the cathodes will not leak back through the other resistors 24. Thus, the voltage at terminal 30 remains substantially equal to the highest voltage at any of the individual voltage dividers. Circuit portion 12 is essentially a voltage divider wherein one side is adjustable so that the triggering of the SCR can be adjusted to compensate for variables such as variation in the values of the resistors and the output voltages of the ballasts. When the voltage at terminal 40 is sufficient to cause the SCR to trigger, bulb 46 illuminates thus signaling the operator that one or more of the lamps have burned out.

The following are suitable component values for the above-described circuit.

| Component | Value |
|---|---|
| 22 | 1 MΩ |
| 24 | 18 KΩ |
| 28 | 1N914 |
| 34 | 220 KΩ |

-continued

| Component | Value |
|---|---|
| 36 | 11 KΩ |
| 38 | 0–5 KΩ |
| 44 | C106C1 |
| 48 | 1N5060 |
| 50 | .1 mfd. |

Although the preferred embodiment has been herein shown and described, modification and variation can be made without departing from the subject of the invention as defined in the following claims.

What is claimed is:

1. A vapor lamp assembly for use with a source of electricity comprising:

a plurality of current limiting ballast devices electrically connected to the electricity source;

a plurality of vapor lamps each having a first terminal supplied an electric potential through a respective current-limiting ballast device;

a plurality of means, each communicating with a respective first terminal of a like number of said vapor lamps, for producing a plurality of first signals proportional to the electric potential of its respective ballast device;

means for summing said first signals from said plurality of first signal producing means to produce a second signal at the output of said summing means; and a trigger circuit means coupled to said summing means output responsive to the level of said second signal for alerting an operator when said second signal is above a first predetermined level to indicate the presence of an inoperative lamp.

2. The indicating device of claim 1 wherein said trigger circuit alerting means further comprises:

means coupled to said summing means output for adjustably modifying said second signal to produce a third signal at the modifying means output; and means coupled to said modifying means output for indicating when said third signal is above a second predetermined level thereby indicating the presence of an inoperative lamp.

3. The indicating device of claim 2 wherein each said first signal producing means includes a voltage divider connected between said first terminal and ground, said dividers each having a first signal terminal at which said first signals are produced.

4. The indicating device of claim 3 wherein said first signal summing means includes a plurality of diodes, a first terminal of each of said diodes connected to a respective first signal terminal, a second terminal of each of said diodes connected to a common point whereby said first signals are summed at said common point.

5. The indicating device of claim 4 wherein said first terminal is an anode.

6. The indicating device of claim 2 wherein said indicating means includes a silicon controlled rectifier, the gate terminal of said silicon controlled rectifier connected to said modifying means output so that said rectifier triggers when said third signal is above said second predetermined level.

7. The indicating device of claim 6 including an indicator lamp connected to the anode of said silicon controlled rectifier so that said indicator lamp illuminates when said third signal is above said second predetermined level and said rectifier triggers.

8. The indicating device of claim 1 wherein said second signal is dependant on the largest valued first signal.

9. The indicating device of claim 1 wherein said second signal is generally equal to the largest valued first signal.

10. A vapor lamp assembly for use with a source of electricity comprising:

a plurality of current limiting ballast devices electrically connected to the electricity source;

a plurality of vapor lamps each having a first terminal supplied an electric potential through a respective current-limiting ballast device;

a plurality of means, each communicating with a respective first terminal of a like number of said vapor lamps, for producing a plurality of first signals proportional to the electric potential of its respective ballast device, said first signal producing means including a voltage divider connected between said first terminal and ground, said dividers each having a first signal terminal at which said first signals are produced;

means for summing said first signals from said plurality of first signal producing means to produce a second signal at the output of said summing means, said first signal summing means including a plurality of diodes, a first terminal of each of said diodes connected to a respective first signal terminal, a second terminal of each of said diodes connected to a common point whereby said first signals are summed at said common point, and a trigger circuit means coupled to said summing means output responsive to the level of said second signal for alerting an operator when said second signal is above a first predetermined level, said trigger circuit means including means coupled to said summing means output for adjustably modifying said second signal to produce a third signal at the modifying means output and for indicating when said third signal is above a second predetermined level thereby indicating the presence of an inoperative lamp, said indicating means including a silicon controlled rectifier, the gate terminal of said silicon controlled rectifier connected to said modifying means output so that said rectifier triggers when said third signal is above said second predetermined level.

11. The combination of claim 10 wherein said second signal is approximately equal to the largest valued first signal.

* * * * *